United States Patent [19]

Crompton et al.

[11] 4,137,426

[45] Jan. 30, 1979

[54] LOADING COIL ASSEMBLIES FOR COMMUNICATION CABLES

[75] Inventors: Eric J. Crompton, Montreal; Serge Poissant, Laprairie; Ian Fordyce, Roxboro, all of Canada

[73] Assignee: Northern Telecom Limited, Montreal, Canada

[21] Appl. No.: 803,470

[22] Filed: Jun. 6, 1977

[51] Int. Cl.[2] ..... H01F 17/08; H01F 17/30

[52] U.S. Cl. ..... 178/46; 336/68; 336/90

[58] Field of Search ..... 178/45, 46; 336/65–68, 336/90, 92; 333/23, 29; 174/70 R, 70 S

[56] References Cited

U.S. PATENT DOCUMENTS

| | | | |
|---|---|---|---|
| 3,969,580 | 7/1976 | Debortoli et al. | 336/65 X |
| 4,002,832 | 1/1977 | Debertoli et al. | 178/46 |

*Primary Examiner*—Alfred E. Smith
*Assistant Examiner*—Marvin Nussbaum
*Attorney, Agent, or Firm*—Sidney T. Jelly

[57] ABSTRACT

A loading coil assembly comprises a casing with an end disc at the inlet end which carries a central column extending axially in the casing. At the end of the column remote from the inlet end a support member is mounted, and a plurality of magazines, each holding a number of coils, hangs from the support member. Additional support members in the form of rings can be mounted on the column, with further magazines hanging from the rings, in one or more circles. The size of casing varies with the number of support members and rings of magazines. The casing is closed by a further end disc and filled with an expanded plastic material. A plastic material outer casing is applied over the casing.

14 Claims, 19 Drawing Figures

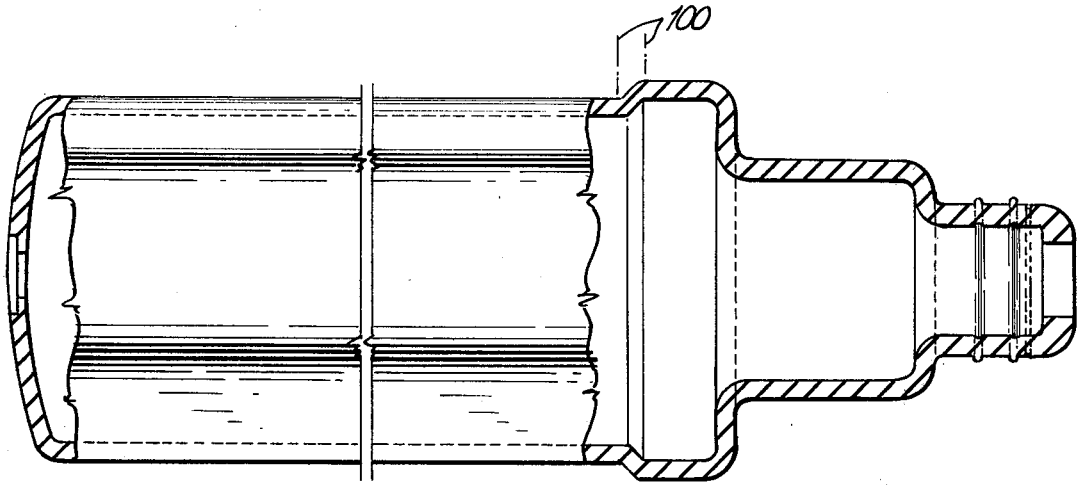
Fig. 15
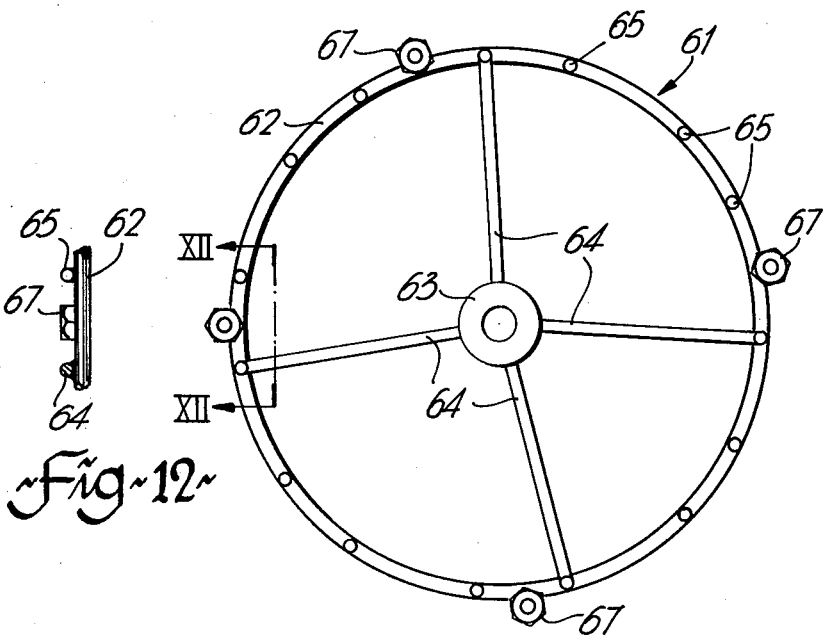
Fig. 12
Fig. 11

LOADING COIL ASSEMBLIES FOR COMMUNICATION CABLES

This invention relates to loading coil assemblies for communications cables, as for example telephone cables, and is particularly concerned with a modification of, and improvement of, such assemblies as are described and claimed in U.S. Pat. No. 3,969,580, issued July 13, 1976.

Loading coils, assembled into casings, are positioned at predetermined positions along a cable to maintain desirable transmission characteristics. Loading coils have been assembled in casings with their axes coaxial or in parallel planes, for example stacked on rods with their axes coaxial. An alternative is with coils in shaped recesses in discs, the discs mounted one above the other.

Care is taken to ensure that the beginnings and ends of adjacent coils are not adjacent but displaced to provide separation, and vertical separation is provided also, to avoid crosstalk. Assemblies are quite large. Attachment of wires from the coils cannot usually be done until assembly into the casing.

The above mentioned patent provides a more compact arrangement, with coils being preassembled into magazines with the magazines assembled into casings. The magazines are supported by mounting rings at the top.

The present invention simplifies the mounting of coil magazines and provides improved access for conductors into and out of the magazine assembly. Magazines are supported around a central column member by hanging from a member at the top of the assembly. Additionally, concentric rings can be added for mounting additional circles of magazines.

The invention will be readily understood by the following description of certain embodiments, by way of example, in conjunction with the accompanying drawings, in which:

FIG. 11 is a plan view of a further form of ring for adding to the central column;

FIG. 12 is a cross-section on the line XII—XII of FIG. 11;

FIG. 15 is a side view, partly in cross-section, illustrating the moulding for the outer jacket of a casing;

Figures 1, 2, 7, 8:
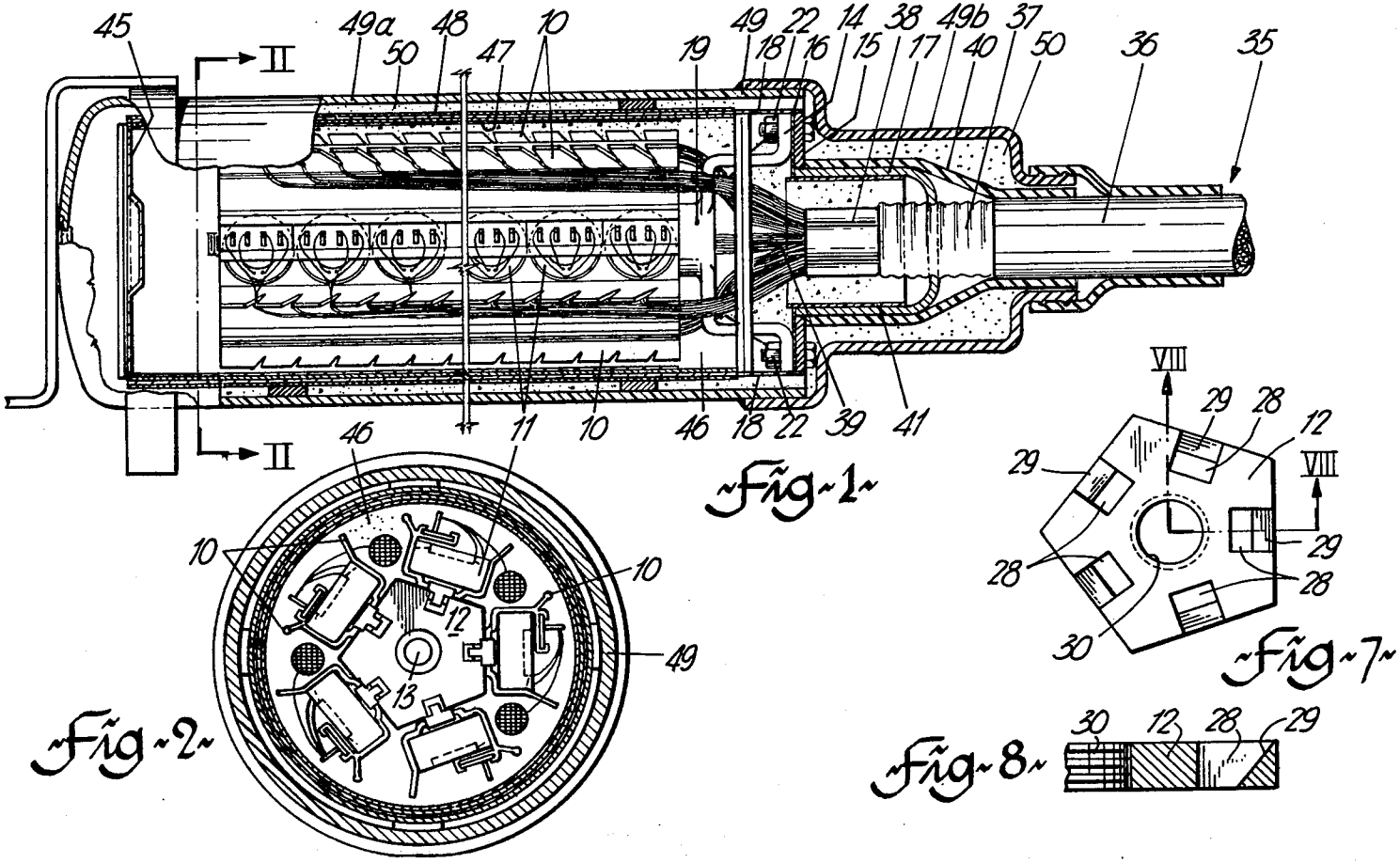
FIG. 1 is a side view of a loading coil case with one circle of magazines, the various casings sectioned.
FIG. 2 is a cross-section on the line II—II of FIG. 1.
FIG. 7 is a plan view of a top support member for the column of FIG. 5.
FIG. 8 is a partial cross-section of the support member of FIG. 7, on the line VIII—VIII of FIG. 7.

As illustrated in FIGS. 1 and 2, an assembled loading coil case comprises a plurality of coil magazines 10, each holding a plurality of coils 11. A typical magazine will be described later. The magazines 10 are supported at one end from a support member 12 at the end of a central column 13. Conventionally, a loading coil case is supported in a vertical position when installed, that is with its longitudinal axis vertical. During assembly the longitudinal axis is vertical and therefore for convenience, the support member 12 will be assumed to be at the top end of the central column 13.

The central column is supported at its lower end on a support bracket 14 which in turn is bolted to a metal end disc 15. An electrically insulating disc 16 is positioned between the end disc 15 and support bracket 14. End disc 15 is attached, as by soldering, to an inlet tube 17. Attached to the periphery of the end disc 15 is an inner casing 18.

Figure 4:
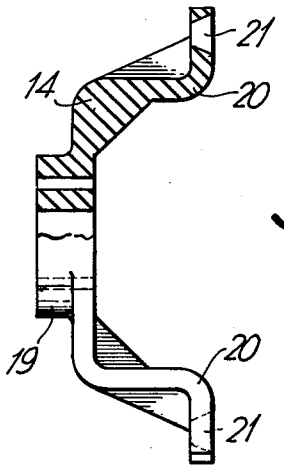
FIG. 4 is a side view of the bracket of FIG. 3, partly in cross-section on the line IV—IV of FIG. 3.
Figure 3:
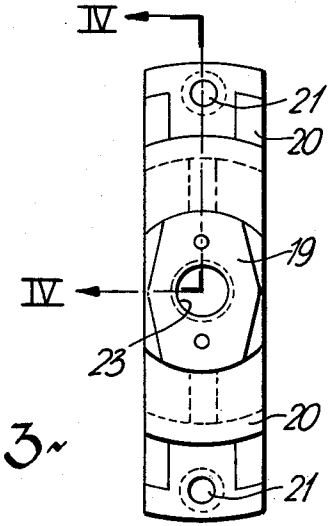
FIG. 3 is a plan view of a bottom mounting bracket for the central column.

The support bracket 14 is illustrated in FIGS. 3 and 4, and comprises a central boss 19 and two cranked legs 20 with holes 21 by which the support bracket is attached to the end disc 15 by studs 22 welded to the end disc 15. The boss 19 has a central threaded hole 23 for screwing onto the threaded bottom end of rod 25.

Figure 5:
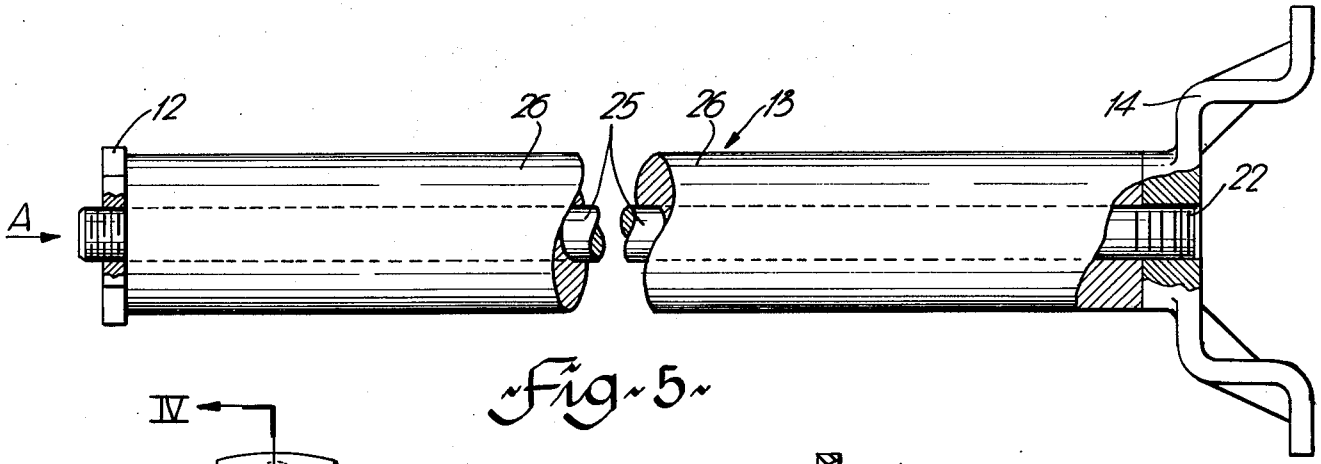
FIG. 5 is a side view of an assembled central column.
Figure 6:
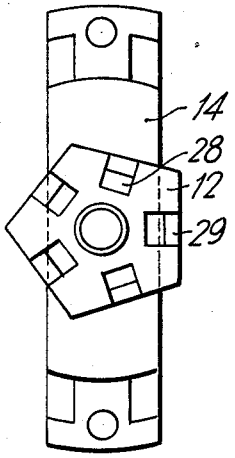
FIG. 6 is an end view in the direction of arrow A in FIG. 5.

The central column 13 is seen more clearly in FIG. 5. The column comprises central rod 25, threaded at both ends, over which fits a tubular member 26. Tubular member 26 is conveniently a foam rubber tube which acts as a filler and a spacer. At its lower end the rod screws into the threaded hole 23 in the support bracket 14, and at its upper end the support member 12 screws on. Support member 12, in the example illustrated, is a five-sided flat plate, as seen in FIG. 6 and illustrated in more detail in FIGS. 7 and 8.

Support member 12 has an aperture 28 at each of its sides, each aperture approximately at a mid-point along each side. The apertures are rectangular with the side adjacent the related side of the support member inclined upwardly and outwardly, as illustrated in FIG. 8, the inclined side of the aperture indicated at 29. A central threaded hole 30 provides for screwing the support member onto the threaded upper end of the rod 25.

The magazine 10, with coils 11 assembled therein, are assembled by hanging on the support member 12. In assembling a load coil case, the cable stub end, indicated generally at 35 in FIG. 1, is positioned vertically, with the outer sheathing 36, metal sheathing 37 and inner sheathing 38 removed to expose the conductors 39. The inlet tube 17 is passed over the cable end and soldered onto the metal sheathing. An outer tube 40, for example of heat shrink material, extends between the outside of inlet tube 17 and the outer sheathing 36, and an electrically insulating tube 41 is inserted inside tube 17.

The support bracket 14 is attached to the end disc 15 and the central column 13 attached to the support bracket. A magazine 10 is hung from each aperture 28 in the support member 12 and the conductors 39 are split up into five bundles 39*a* and brought up between the magazines, the conductors being connected to terminals on the magazines, as described later.

After loading of the magazines, the inner casing is soldered to the end disc 15 and, an upper end disc 45 is soldered to the upper end of the inner casing 18. The interior of the casing is then filled with an expanding plastic material 46. An inner insulating tube 47 can be inserted inside the inner casing 18 after soldering to the end disc 15.

An outer electrically insulating tube 48 can be positioned over the inner casing 18 and then an outer casing 49 applied. Conveniently the outer casing 49, generally of a plastic material, is in two parts 49*a* and 49*b*. Upper part 49*a* surrounds the main casing and lower part 49*b* decreases in diameter and is eventually a close fit over the lower end of the inlet tube 17. The space between the outer casing and inlet casing and inlet tube is then filled with a suitable material, for example an expanded plastic material, 50.

To provide for variation in the number of loading coils provided, this variation arising because of different cable sizes, it is possible to assemble more than one circle of magazines. This is done by providing additional support members at the top of the central column, and hanging magazines on these additional support members. In the present example, the additional support members are in the form of rings attached to a central boss by spokes.

Figure 9:
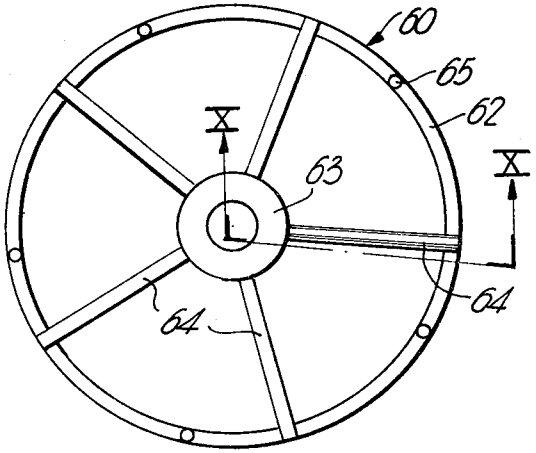
FIG. 9 is a plan view of one form of ring for adding to the centre column for supporting an additional circle of magazines.
Figure 10:
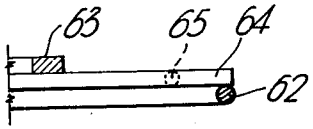
FIG. 10 is a cross-section on the ine X—X of FIG. 9.

FIGS. 9 to 11 illustrates two rings 60 and 61. Ring 60 is smaller and is of a size to carry a circle of magazines immediately outside the first ring. Ring 61 allows a further circle of magazines to be assembled surrounding the circle supported by ring 60. In both rings there is a rim 62 of, in the example illustrated, a round rod supported from a central boss 63 by spokes 64. The spokes 64 serve also as circumferential locating means for magazines, but additional locating means 65 are also provided. The rims, central bosses and spokes are conveniently assembled by welding together, and the additional locating means 65 can be balls or short lengths of rod welded to the rim.

To provide additional support, nuts 67 can be welded to ring 61, long rods, not shown, being screwed into the nuts and extend down to an enlarged base plate.

Figure 14:
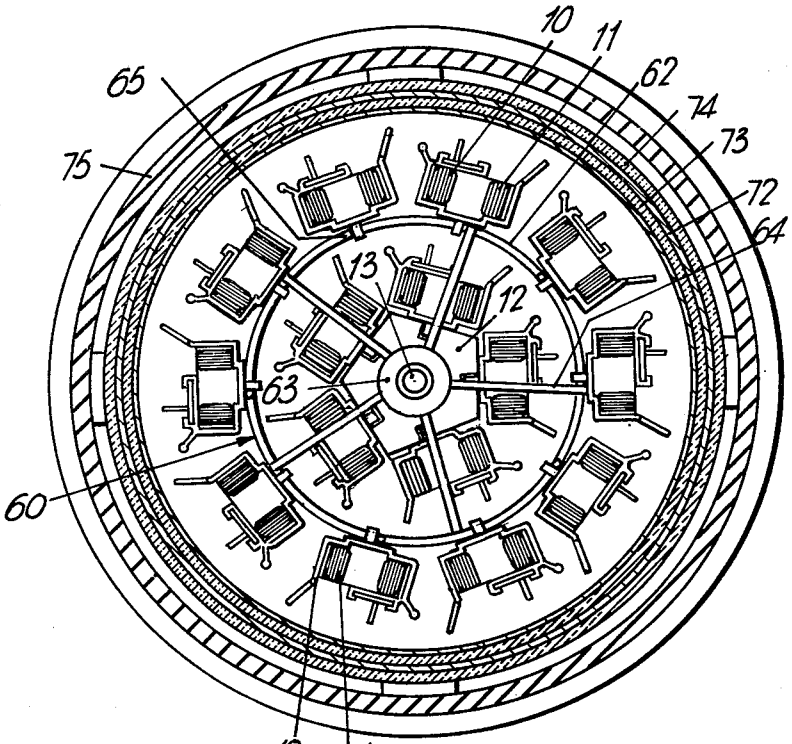
FIG. 14 is a cross-section on the line XIV—XIV of FIG. 13.
Figure 13:
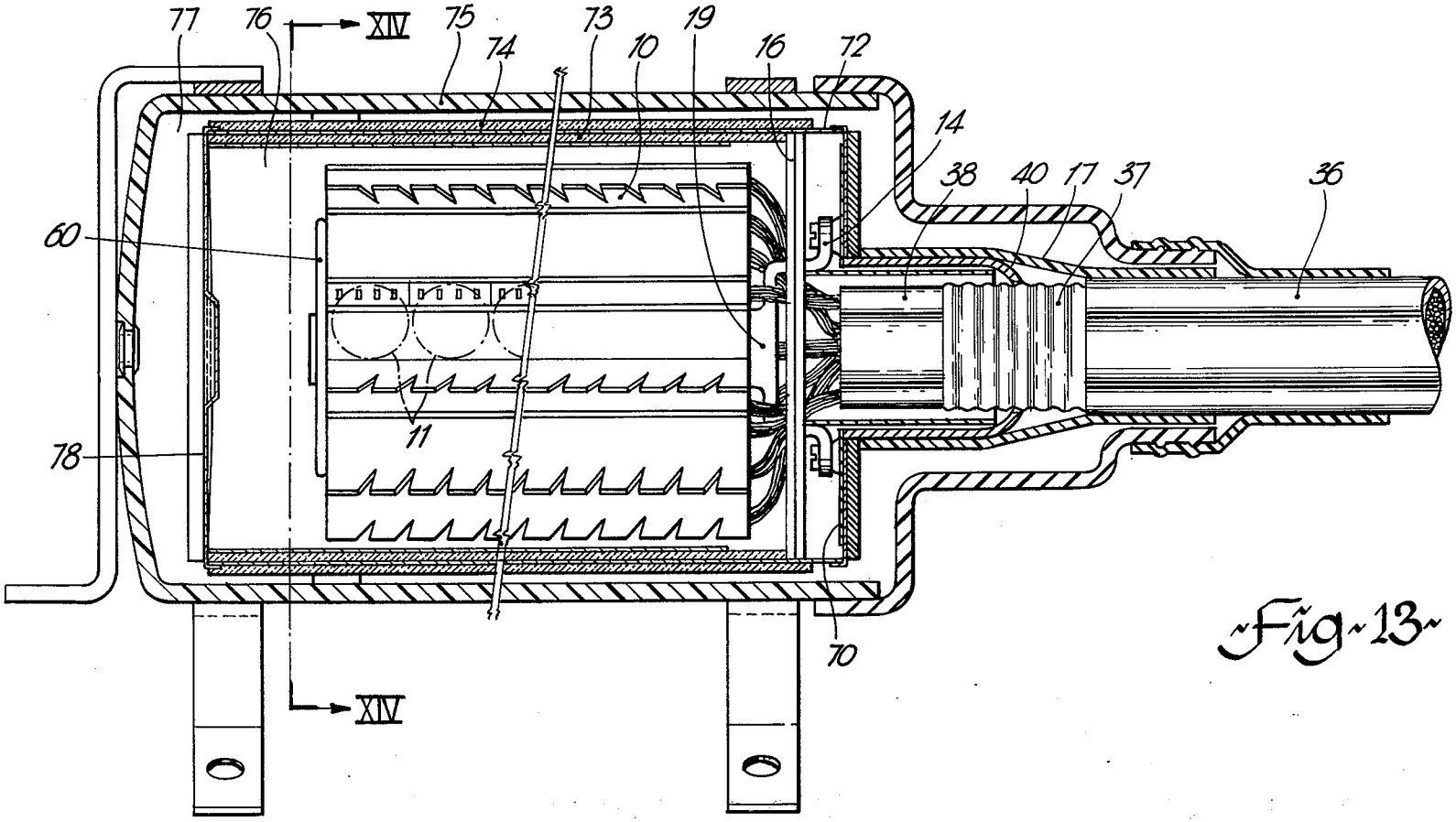
FIG. 13 is a side view of a loading coil case with two circles of magazines, the casing sectioned.

FIGS. 13 and 14 illustrate an assembled loading coil case having two circles of magazines 10 with coils 11. Only two coils 11 are shown in FIG. 13, although all the magazines 10 will be loaded with coils. Common items with the loading coil case of FIGS. 1 and 2 have the same reference numerals. In this example, the support bracket 14 is attached to a larger diameter end plate 70. At the upper end of the central column 13 an additional support member 60 is provided. The central boss 63 of the support member has a bore 71 which fits onto the threaded top end of the rod 25 of the central column 13. The threaded top end of the rod extends beyond the support member 12.

A large diameter inner casing 72, insulating sleeves 73 and 74 and outer casing 75 are provided. The space 76 inside the inner casing 72, and the space 77 between inner and outer casings 72 and 75, are filled with, for example, expanded resin. The upper end of the inner casing 72 is closed by a top end plate 78.

The outer casing 49 in FIG. 1, and 75 in FIG. 2, are conveniently of a formed plastic. In the examples illustrated the casings are moulded by injecting plastic material in a liquid form into a rotating female mold. With such a process it is necessary to provide that each end of the mold projects inwards. To make the casing in two parts, two molds would be necessary and also, after molding, one end of each molding would need cutting off.

In the present example, the casing is made as one piece of the form illustrated in FIG. 15. After manufacture the molding is then cut on the two lines indicated at 100. This provides the two parts for a casing at one molding operation, with an overall reduction of mold cast and labour and also a reduction in scrap material. After assembly over a case, the two parts are plastic molded together.

Figure 16:
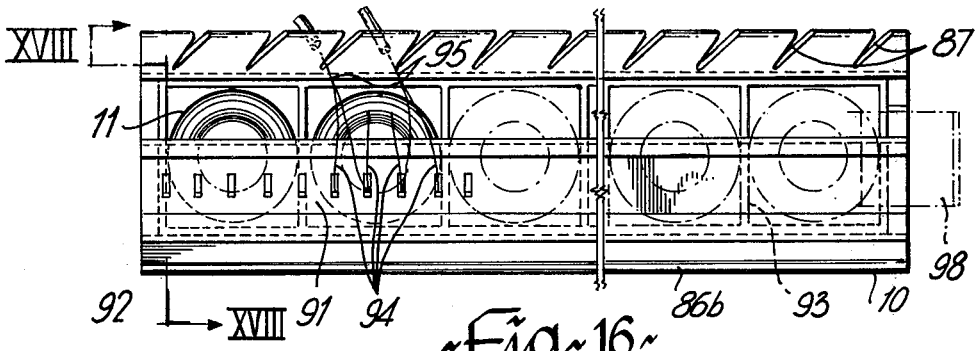
FIG. 16 is a plan view of one form of loaded magazine.
Figure 17:
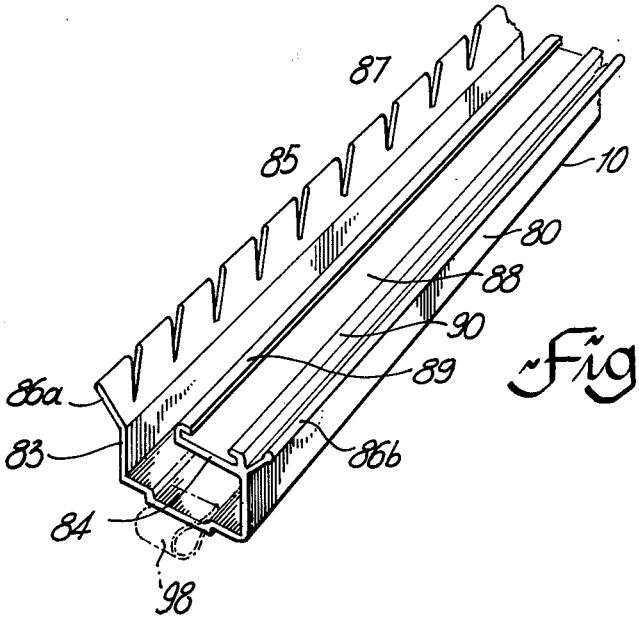
FIG. 17 is a perspective view of an extrusion for a magazine as in FIG. 16.
Figure 18:
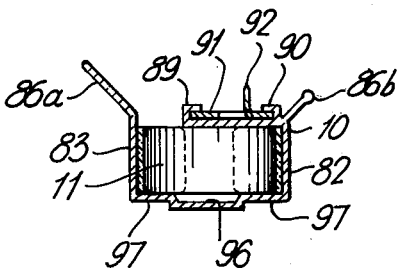
FIG. 18 is an end view of the magazine of FIG. 16, with end cap removed.

FIGS. 16, 17 and 18 illustrate a form of coil magazine in more detail. The magazines can be preassembled with the loading coils, with the coils wired to terminal strips, and with the coils oriented to avoid magnetic field interference. The loading coils are placed in a magazine which comprises a length of extruded, or molded material, plastic material generally the length of the magazine being variable to accommodate differing number of coils. Terminal strips are held in a formation on the magazine, and adhesive tape wrapped over each end to retain the coils in position during assembly.

As seen in FIG. 17, the main body 80 of a magazine 10 is in the form of an extrusion having a modified channel-shaped cross-section. Thus there is a base web 81, two parallel side webs 82 and 83 and an inwardly extending top web 84 extending from the top edge of side web 82 towards side web 83. Top web 84 extends only part way across the body 80 to leave an access slot 85. At the top edges of the side webs 82 and 83 extend outwardly inclined webs 86*a* and 86*b*. Inclined slots 87 are formed in web 86*a* which acts as a fanning strip for the cable pairs. The two webs 86*a and 86b* assist in assembly in that they can act as supports and guides for flow soldering of the terminals. Also web 86*b* assists in holding wires in place on vertical runs.

The top surface of top web 84 is shaped to provide a shallow channel 88 with inturned edges 89 and 90. Terminal strips 91 (FIG. 16) slide into the shallow channel 88 from the end of the body 80. Conveniently each terminal strip has four terminals 92 and serves for one coil. If desired longer terminal strips could be used with more than four terminals. Also the terminals could be mounted by some other arrangement for example ultrasonically inserted directly to the top surface of the web.

The arrangement of coils 11 and terminal strips 91 is seen in FIGS. 15 and 17, coils 11 being shown in the main body 80, together with associated terminal strips 91. Each coil is separated by a plastic molding 93. Attaching of the wires 94 from the coils 11 to the terminals 91 to a large extent prepositions the coils so that the beginnings and ends of the windings, which are at the positions at which the wires 94 extend from the coil, as seen in FIG. 15, are not adjacent to each other in adjacent coils. This positioning prevents excessive magnetic coupling between adjacent coils. Generally the coils 11 are positioned as illustrated in FIG. 15. The conductors from the cable are indicated at 95.

The coils are a fairly close fit in the main body 80 and are slid in from one end. To reduce friction between coils and the base web 81 this is shaped to have a recessed centre portion 96 and raised side portions 97, although this is not essential. This is seen quite clearly in FIG. 17. The recessed portion also allows for a rear entrance slot to the coils when potting the coils with a polyurethane type filler compound.

The coils can be fed in from both ends of the body 80 or only from end, as desired. If the magazine is of flexible material, the coils can also be inserted via the longitudinal opening. End clips 98 are fitted on one end of the body to provide attachment means for the magazine, as illustrated in FIG. 16.

Figure 19:
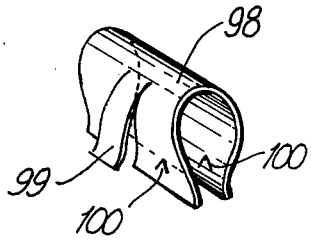
FIG. 19 is a perspective view of one form of clip for suspending magazines.

FIG. 19 illustrates one form of clip 98. A clip is formed from strip spring material bent generally into the form of a U. On one side a tongue 99 is cut and bent outwards. Inwardly extending barbs 100 are formed in the legs of the clip, toward the edges. A clip is forced over the end of a magazine, the barbs engaging with the magazine. With a magazine of plastic material the barbs will dig into the material. The tongue 99 serves to either enter the apertures 28 of a support member 12, or engage over rings 60 and 61.

To provide for differential expansion between the metal casing and the plastic casing, and the foamed material, discs of a foam material are positioned in the cases. These are indicated at 105 in FIGS. 1 and 16. Similarly the inner and outer tubes 47 and 48 of FIG. 1 and sleeves 73 and 74 of FIG. 16 are conveniently of a foam material to provide for the differential expansion.

After assembly of the coils into a magazine, attaching of end caps and soldering or otherwise connecting wires to the terminals, there is provided a compact assembly for attachment to a support structure of a casing. The connection of the wires from the coils to the terminals is done at the magazine assembly stage. With the coils positioned side-by-side, with their axis perpendicular to the assembly plane, there is only line contact between adjacent coils, and even here there is slight separation by the plastic sleeve 93. Thus cross-talk is reduced to a minimum. Also, as described above, the connecting of wires 95 to the terminals 91 on the terminal strips 91 — with the offset positioning of the terminal strips relative to the coil axes, tends to ensure that the coil winding starts and ends of adjacent coils are spaced apart from each other.

The number of coils per magazine can be varied by variation of the length of the body 70. As described, a varying number of magazines can be mounted in a casing and it is possible to provide for a considerable variation in number of coils by varying the length of a magazine and the number of magazines in a casing. It has been found convenient, for example, to provide four different lengths of magazines and three different casing sizes, that is three different numbers of magazines.

It has been found convenient also to provide for two different coil sizes, one for suburban use and a larger coil for rural areas where conditions of service can be more severe. For the larger coils, magazines having a larger cross-section are used. The same alternative magazine lengths are provided — holding fewer coils, and the number of magazines per casing are reduced to use the same casing sizes as for the smaller coils.

What is claimed is:

1. A loading coil assembly, comprising:

a cylindrical casing having first and second end discs, the first end disc at an inlet end of the casing and the second end disc closing the end of the casing remote from said inlet end;

an inlet tube attached to said first end disc and extending axially from said casing, said inlet tube aligned with an aperture in said first end disc;

a support bracket mounted on said first end disc within said casing and extending diametrically across said casing;

a central column member attached at one end to said support bracket and extending axially from said support bracket coaxial with the longitudinal axis of the casing;

a flat support member mounted on the other end of said central column member, said support member including a series of apertures spaced around its periphery;

a plurality of assembled loading coil magazines in said casing, said magazines extending axially and spaced around said central column member;

suspension means at one end of each magazine, said suspension means inserted into said apertures in said support member;

expanded synthetic resin electrically insulating material filling spaces in said casing;

an outer plastic material casing surrounding said casing and said inlet tube, said outer plastic casing closed at the end remote from said inlet tube and spaced from said casing; and expanded synthetic resin material filling the space between the casing and the outer plastic casing.

2. An assembly as claimed in claim 1, further including:

at least one further support member mounted on said central column at the end at which is mounted said flat support member, said further support member including support means extending around and spaced from the periphery of the said flat support member; and a further plurality of assembled loading coil magazines suspended from said further support member.

3. An assembly as claimed in claim 2, including two further support members, a first surrounding and spaced from the flat support member and a second surrounding and spaced from said first further support member.

4. An assembly as claimed in claim 2, each further support member comprising a central boss mounted on the central column member, a series of radially extending spokes attached at an inner end to said boss, and a ring attached to the outer ends of said spokes.

5. An assembly as claimed in claim 1, said central column member comprising a central rod attached to said support bracket and a tube of resilient material surrounding said rod.

6. An assembly as claimed in claim 1, including at least one disc-like member of foam plastic material extending across said casing at a position between the ends of said loading coil magazines and said first end disc.

7. An assembly as claimed in claim 1, including a layer of foam plastic material on the inside surface of said cylindrical casing.

8. An assembly as claimed in claim 1, including a layer of foam plastic material on the outer surface of said cylindrical casing.

9. An assembly as claimed in claim 1, each of said loading coil magazines comprising:

a body member of a length of preformed electrically insulated material having a channel shaped cross section including a base web, two spaced apart side webs extending from said base web, and a top web on an upper part of a first one of said side webs, said top web extending inwardly over and spaced from said base web;

at least one terminal strip on said top web and including terminals thereon;

a plurality of loading coils positioned side by side in said body member, the axes of said coils parallel and extending normal to said base web, each end of the winding of the coil attached to a related terminal;

a spring clip at one end of said body member, said spring clip including an outwardly extending tongue for suspending the magazine.

10. A loading coil assembly as claimed in claim 7, including an inclined web at the top of a second one of said side webs, said inclined web extending in a direction away from said base web, and slots in said inclined web, said slots adapted for the acceptance of conductors for attachment to said terminals, and a further inclined web at the top of said first one of said side webs, said further inclined web away from said base web and outwardly from said top web.

11. A loading coil assembly as claimed in claim 9, said top web including inturned edges to define a shallow channel cross-section, said terminal strip being a sliding fit in said channel.

12. A loading coil assembly as claimed in claim 9, said terminal strip extending the full length of said body member.

13. A loading coil assembly as claimed in claim 9, including a plurality of terminal strips, a strip for each coil.

14. An assembly as claimed in claim 1, said inlet tube soldered to a metal sheathing of a cable, and including an outer tube of plastic material over said inlet tube and extending over an end of a plastic sheathing over said metal sheathing of said cable, said outer plastic casing extending over said outer tube of plastic material and having an end portion a close fit over said outer tube, and a sleeve of plastic material over said end portion and an adjoining portion of said plastic sheathing of said cable.

* * * * *